US007365616B2

(12) United States Patent
Takeda et al.

(10) Patent No.: US 7,365,616 B2
(45) Date of Patent: Apr. 29, 2008

(54) NON-RECIPROCAL ELEMENT WITH THREE CENTRAL CONDUCTORS AND COMMUNICATION APPARATUS USING THE SAME

(75) Inventors: Shigeru Takeda, Kumagaya (JP); Hideto Mikami, Kumagaya (JP); Koji Ichikawa, Saitama (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 10/968,039

(22) Filed: Oct. 20, 2004

(65) Prior Publication Data

US 2005/0083146 A1 Apr. 21, 2005

(30) Foreign Application Priority Data

Oct. 20, 2003 (JP) ..... 2003-358754

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS 4,210,886 A * 7/1980 Enderby et al. ..... 333/24.2
5,745,014 A 4/1998 Okada et al.
5,838,209 A 11/1998 Okada et al.
5,994,974 A 11/1999 Makino et al.
2003/0067365 A1* 4/2003 Kawanami et al. ..... 333/24.2
2003/0085769 A1* 5/2003 Saito et al. ..... 333/1.1

FOREIGN PATENT DOCUMENTS

JP 8-8613 1/1996
JP 2001-111309 4/2001

* cited by examiner

*Primary Examiner*—Stephen E. Jones
(74) *Attorney, Agent, or Firm*—Antonelli, Terry, Stout & Kraus, LLP.

(57) ABSTRACT

A non-reciprocal element with three central conductors and a communication apparatus are disclosed, in which the insertion loss is small and the bandwidth is wide. Three central conductors are arranged in proximity to a ferrite thin plate in such a manner as to cross each other in a mutually electrically insulated state. A static magnetic field is applied to the ferrite thin plate by a permanent magnet. An end each of the three central conductors makes up three input/output terminals, respectively, and the other end thereof is connected to a common portion. Three matching capacitors are connected between an end each of the three input/output terminals, respectively, and the common portion. At least one of the angle between the first and second central conductors and the angle between the second and third central conductors is not more than 90 degrees.

11 Claims, 9 Drawing Sheets

$V_A + V_B \fallingdotseq 2V_A >> V_C - V_D$

NON-RECIPROCAL ELEMENT WITH THREE CENTRAL CONDUCTORS AND COMMUNICATION APPARATUS USING THE SAME

BACKGROUND OF THE INVENTION

1. Field of the Invention

The present invention relates to an isolator/circulator constituting a radio-frequency non-reciprocal element, or in particular to a non-reciprocal element with three central conductors having a small insertion loss and a wide bandwidth characteristic.

2. Description of the Related Art

In the current technical situation of the isolator constituting a radio-frequency non-reciprocal element, the configuration is generally used in which one of the terminals of a three-terminal pair coupled circulator is terminated with a matched impedance. This coupled circulator is classified into two types, i.e. the distributed-element circulator and the lumped-element circulator. The circulator has non-reciprocal electrical characteristics and has such a basic structure that a magnetic field is applied in the direction perpendicular to a ferrite thin plate and a conductor is arranged in proximity to the periphery of the ferrite thin plate. The distributed-element circulator is used in the case where the size of the isolator element is not less than one fourth of the wavelength of the radio frequency propagating through the ferrite thin plate, and the lumped-element circulator in the case where the size of the isolator element is not more than one eighth of the wavelength of the radio frequency. The lumped-element circulator is more suitable for a compact structure.

FIG. 21 is a schematic diagram showing the structure and the circuits of an isolator implemented by connecting a matched impedance (resistor R) to an end of a lumped-element circulator with three terminal pairs currently used with a mobile phone. A ferrite thin plate G is composed of garnet ferrite, and three central conductors L1, L2, L3 are arranged on the upper surface of the ferrite thin plate G at intervals of 120 degrees as shown in FIG. 20. An end of each central conductor makes up an input/output line of the corresponding one of terminal pairs (1), (2), (3), and the other end of the central conductor is connected to a common portion GR constituting a ground conductor. Matching capacitors C1, C2, C3 are connected in parallel between an end of the central conductors L1, L2, L3, respectively, and the common portion GR. The resistor R for absorbing the energy to implement the isolator is mounted between the terminal pair (3) and the common portion GR. A permanent magnet is mounted, though not shown, in such a manner that a static magnetic field is applied in the direction substantially perpendicular to the main surface of the ferrite thin plate G. By carefully adjusting the direction and strength of the static magnetic field and the size of the central conductors L1, L2, L3 and the matching capacitors C1, C2, C3, the structure shown in FIG. 21 operates as a circulator at the desired frequency (hereinafter referred to as "the center frequency") fo. Thus, the radio frequency input from the terminal pair (1) is propagated to the terminal pair (2), and the radio frequency input from the terminal pair (2) is propagated to the terminal pair (3), with a small loss. As long as the resistor R is connected to the terminal pair (3), most energy is absorbed there, and substantially no radio frequency is propagated to the terminal pair (1) from the terminal pair (2). In other words, an isolator can be implemented in which the propagation is promoted only in one direction and blocked in the other direction.

In the prior art, the intersection angle of the terminal pairs (1), (2), (3) is set normally to 120 degrees. Nevertheless, a non-reciprocal element with three central conductors in which the intersection angle is set to unequal angles has also been proposed. U.S. Pat. Nos. 5,745,014 and 5,994,974 are examples.

The conventional structure shown in FIG. 21, which is symmetric and advantageously easy to fabricate, has the disadvantage is that the insertion loss is not reduced much and the bandwidth is small. Also, the structure disclosed in U.S. Pat. Nos. 5,745,014 and 5,994,974 has the insertion loss and bandwidth not sufficiently improved. These conventional techniques pose the problem that the cost is difficult to reduce.

SUMMARY OF THE INVENTION

The object of this invention is to provide a non-reciprocal element with three central conductors with a small insertion loss and a wide bandwidth and a communication apparatus using the same non-reciprocal element.

In the non-reciprocal element with three central conductors according to the invention, first, second and third central conductors are arranged in proximity to a ferrite thin plate with a static magnetic field being applied by a permanent magnet. One end each of the first, second and third central conductors constitutes the corresponding one of the first, second and third input/output terminals, respectively. The other end each of the first, second and third central conductors is connected to a common portion. First, second and third matching capacitors are connected between the common portion and the first, second and third input/output terminals, respectively. One or both of the angle $\phi$ between the first and second central conductors and the angle $\theta$ between the second and third central conductors are not more than 90 degrees.

In the non-reciprocal element with three central conductors according to the invention, the angle $\phi$ between the first and second central conductors is preferably about 60 degrees, and the angle $\theta$ between the second and third central conductors is preferably about 60 degrees.

In the non-reciprocal element with three central conductors according to the invention, a resistor can be connected between one of the first and third input/output terminals and the common portion to make up an isolator. Specifically, the resistor is inserted between the common portion and one of the first and third input/output terminals arranged at the extreme ends of the input/output terminal group, and one of the remaining two input/output terminals constitutes an input terminal while the last terminal constitutes an output terminal. The central conductor making up an input terminal and the central conductor making up an output terminal are arranged adjacently to each other at the angle $\phi$ or $\theta$ of not more than 90 degrees, or especially about 60 degrees to make up an isolator.

In the non-reciprocal element with three central conductors according to the invention, a resistor can be connected also between the second input/output terminal and the common portion to constitute an isolator.

In the non-reciprocal element with three central conductors according to the invention, the input/output terminal at an end each of the first, second and third central conductors can be laterally juxtaposed along a side of the ferrite thin plate.

In the non-reciprocal element with three central conductors according to the invention, the central portion of at least one of the first, second and third central conductors can be divided into three or more conductive lines.

The communication apparatus such as a mobile phone according to the invention comprises at least one non-reciprocal element with three conductors described above.

Other objects, features and advantages of the invention will become apparent from the following description of the embodiments of the invention taken in conjunction with the accompanying drawings.

DESCRIPTION OF THE INVENTION

[1] First Embodiment

Figure 1A:
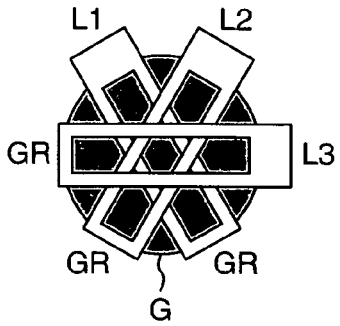
FIGS. 1A and 1B are top plan views of the central conductors and the ferrite thin plate assembled together according to an embodiment of the invention.
Figure 1B:
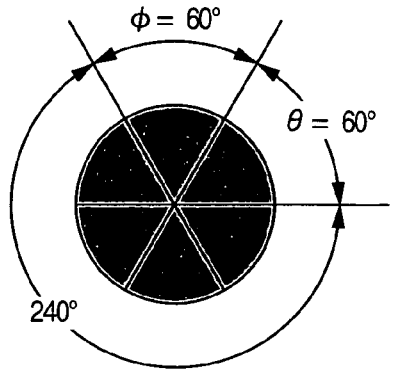

FIGS. 1A, 1B are assembly diagrams showing central conductors and a ferrite thin plate according to an embodiment of the invention. First, second and third central conductors L1, L2, L3 crossed and electrically insulated with each other are arranged on the disk-like ferrite thin plate G. The difference of this embodiment from the prior art lies in that the intersection angle $\phi$ between the first and second central conductors is not 120 degrees but 60 degrees. The intersection angle is defined as the angle between the center lines of the central conductors crossing the ferrite thin plate as viewed from the input/output terminal. In similar fashion, the intersection angle $\theta$ between the second and third central conductors is 60 degrees. The inventor has found that this configuration remarkably improves the insertion loss and the isolation bandwidth. The electrical insulation, though not shown, can be achieved by inserting Teflon or polyimide adhesive tape between the central conductors or by applying an insulating film such as a resist on the surface of the central conductors.

Figure 2:
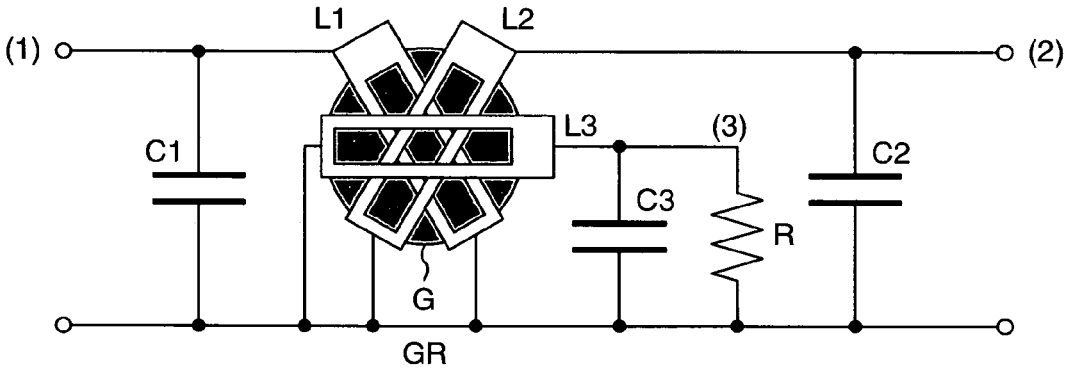
FIG. 2 shows an equivalent circuit of the isolator based on the non-reciprocal element with three central conductors according to an embodiment of the invention.

FIG. 2 is a circuit diagram showing an isolator realized by connecting an accessorial parts to the assembly of the central conductors and the ferrite thin plate according to the embodiment of the invention shown in FIG. 1. The ferrite thin plate G is impressed with a static magnetic field Hex by a permanent magnet not shown. An end each of the first, second and third central conductors makes up input/output terminals (1), (2), (3), respectively, and the other end thereof is connected to a common portion GR. The common portion GR is normally a ground conductor connected to the ground. The first, second and third matching capacitors C1, C2, C3 are mounted between the input/output terminals (1), (2), (3), respectively, and the common portion GR. A resistor R is inserted between the input/output terminal (3) and the common portion GR. According to this embodiment, the direction in which the static magnetic field is applied to the ferrite thin plate G from an external source is determined in such a manner that the terminal (1) constitutes an input terminal and the terminal (2) an output terminal. The invention, however, is not limited to this configuration, but the terminal (2) may constitute an input terminal and the terminal (1) an output terminal with equal effect. Also, the resistor R may be inserted between the input/output terminal (1) or (2) and the common portion GR instead of between the input/output terminal (3) and the common portion GR.

[Difference from Prior Art]

A non-reciprocal element with three central conductors, in which one of the intersection angles formed by the three central conductor pairs configured of the input/output terminals (1), (2), (3) is set to a different value from the remaining two intersection angles, is disclosed in U.S. Pat.

No. 5,745,014. The difference of the invention as found by the present inventor, however, is that the insertion loss and the isolation bandwidth are both remarkably improved in the case where one or both of the angle $\phi$ between the first and second central conductors and the angle $\theta$ between the second and third central conductors is set to 90 degrees or less, or especially in the case where both angles $\theta$ and $\phi$ are set to about 60 degrees. The configuration in which the angles $\phi$ and $\theta$ are set to 90 degrees or less is illustrated in U.S. Pat. No. 5,994,974, in which both the angle $\theta$ between the first and second central conductors and the angle $\theta$ between the second and third central conductors are set to 70 degrees. In spite of this fact, the present invention is different in that one of the central conductors (first or third central conductor) located at the ends of the three central conductors is connected with a resistor to make up an isolator. According to this invention, there is provided an isolator in which the input terminal and the output terminal are adjacent to each other without any other intermediary terminal and the intersection angle between the central conductors making up the input terminal and the output terminal is set to 90 degrees or less, or especially about 60 degrees. This structure greatly improves the insertion loss and the bandwidth. In U.S. Pat. No. 5,994,974, on the other hand, an isolator is configured by connecting a resistor to the central one (second central conductor) of the three central conductors. Thus, the intersection angle between the central conductors making up an input terminal and an output terminal is 140 degrees. This configurational difference fails to improve the insertion loss and the bandwidth. The reason is described below.

[Effect of Insertion Loss]

Figure 3A:
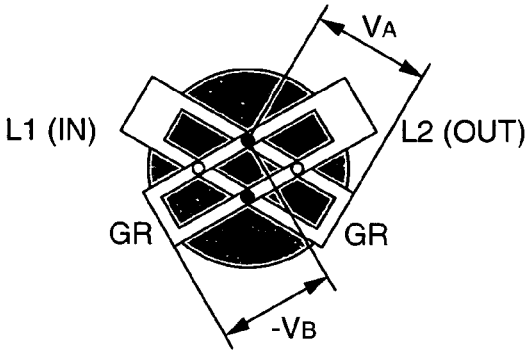
FIG.3A PRIOR ART
FIGS. 3A and 3B are diagrams for comparing the prior art with the invention and explaining the superiority in respect of the voltage difference of the central conductors according to the invention, respectively.
Figure 3B:
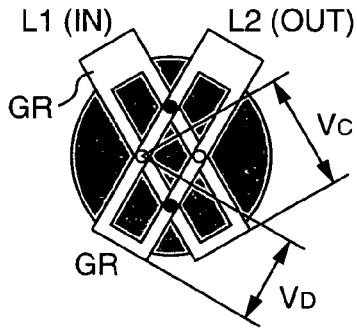

FIGS. 3A and 3B are diagrams for explaining the advantages of this invention by comparison with the prior art. FIG. 3A shows the prior art, and FIG. 3B the invention. In both the prior art and the invention, the first central conductor L1 and the second central conductor L2 are selected for explanation. The intersection angle is 120 degrees for the prior art, and the intersection angle is 60 degrees for the invention. In both cases, the first central conductor L1 is on the input terminal side, and the second central conductor L2 on the output terminal side. The third central conductor L3 is connected with a resistor and constitutes a load terminal. In FIGS. 3A, 3B, the central conductor L3 is not shown as it is not directly related to the explanation of the advantage of the invention. First, in the case where the circulator operates ideally, the input voltage and the output voltage are in opposite phases according to the prior art. In the case where both the angles $\phi$ and $\theta$ are 90 degrees or less (60 degrees in this case) according to the invention, on the other hand, the input voltage and the output voltage are in phase with each other. Specifically, in the case where the voltage on the common portion GR side of the central conductors is zero, the voltages at the other end (input terminal) of the central conductor L1 and the other end (output terminal) of the central conductor L2 have opposite signs according to the prior art (FIG. 3A). According to the invention, however, the signs are the same with an equal absolute value (FIG. 3B). The actual central conductors L1, L2 each include two parallel conductor lines, and have a plurality of different points of intersection. The black circles, for example, indicate points where the absolute voltage values of the two central conductors are equal to each other. The while circles, on the other hand, indicate points where the absolute voltage values of the two central conductors are different from each other. In the case where the central conductor is configured of a single thin conductor line instead of two conductor lines, then the two central conductors always intersect each other at the center of the ferrite thin plate G, and therefore regardless of the intersection angle of the central conductors, the absolute voltage value at the intersection is always substantially the same. Actually, however, the central conductor having two or more conductor lines is used to secure a uniform radio-frequency magnetic field in the ferrite thin plate.

In the case where a set of parallel two conductor lines intersect another set of parallel two conductor lines as shown in FIGS. 3A, 3B, a voltage difference develops at each intersection. Specifically, in the case where the intersection angle is 120 degrees as shown in FIG. 3A, the voltage difference between the two central conductors is largest at the points indicated by black circles and given as $V_A+V_B\approx 2V_A$. In the case where the intersection angle is 60 degrees as in FIG. 3B, on the other hand, no voltage difference develops at the points indicated by the black circles, and the voltage difference is largest at the points indicated by the white circles and given as $V_C-V_D$. As apparent from FIGS. 3A, 3B, the relation holds that $V_A+V_B\approx 2V_A>>V_C-V_D$, where $V_A$, $V_B$, $V_C$, $V_D$ are the absolute values of the voltage at the respective points.

This is indicative of the fact that according to the prior art (FIG. 3A), when energy propagates from the input terminal to the output terminal, the voltage difference at the intersection of two central conductors is so large that the radio frequency current is liable to flow through the line capacity. This radio frequency current makes no direct contribution to the circulator operation, and therefore deteriorates the insertion loss characteristic of the isolator. According to the technique of the invention (FIG. 3B), on the other hand, the voltage difference at the same intersection is as small as ⅕ to 1/10 of the value for the prior art, and thus the unnecessary radio frequency current is greatly reduced for the same line capacity, thereby having a favorable effect on the insertion loss characteristic.

As described above, the feature of this invention lies in that the intersection angle between the central conductor making up the input terminal and the central conductor making up the output terminal is set to not more than 90 degrees, or desirably 60 degrees. In U.S. Pat. No. 5,994,974, a resistor is inserted between the middle one (second central conductor) of the three central conductors and the common portion. In this case, a termination terminal is interposed between the input terminal and the output terminal, and the intersection angle between the input terminal and the output terminal is 140 degrees. Therefore, the required relation of the voltage difference fails to hold, and the bandwidth of the insertion loss is not improved.

[Isolation Effect]

Next, in the configuration shown in FIGS. 3A, 3B, assume that the first central conductor L1 constitutes the output terminal, and the second central conductor L2 is connected to a resistor and terminated (load). The third central conductor L3 which constitutes the input terminal is not shown. Consider the isolation characteristic of this configuration. The voltage relation described above holds between the first central conductor L1 and the second central conductor L2, and therefore the radio frequency current easily flows through the line capacity in the case where the intersection angle is 120 degrees as in the prior art. This radio frequency current fails to directly contribute to the operation of the circulator, and therefore deteriorates the isolation characteristic. According to this invention, in contrast, the unnecessary radio frequency current is greatly reduced for the same line capacity, and therefore the isolation characteristic is improved. Thus, the isolation bandwidth is improved.

[Central Conductors]

Figure 4A:
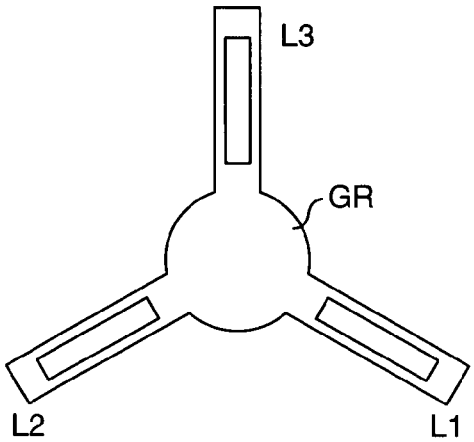
FIG.4A PRIOR ART
FIGS. 4A and 4B are diagrams for comparing the prior art with the invention and explaining the superiority in respect of the central conductors according to the invention, respectively.
Figure 4B:
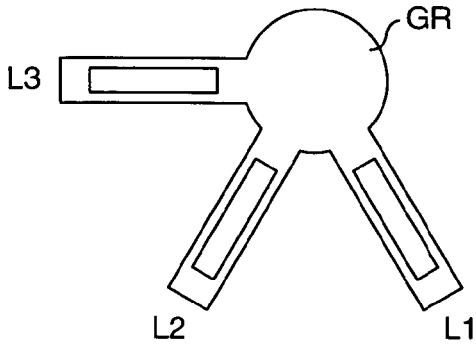

FIGS. 4A and 4B are diagrams for explaining another advantage of this invention. The central conductor is generally fabricated by etching or punching a copper plate with a die. FIG. 4A is a development of the conventional central conductor. The conductor expands in three directions symmetrically, so that the number of central conductors fabricated per unit area of the copper plate is small. This compares with the development of the central conductor according to the invention shown in FIG. 4B, in which the pattern is concentrated in the lower half portion in compact form and therefore the number of central conductors secured per unit area of the copper plate is increased. This greatly contributes to the highly-demanded cost reduction of the isolator of mobile phones.

[Equivalent Circuit of Isolator]

Figure 5:
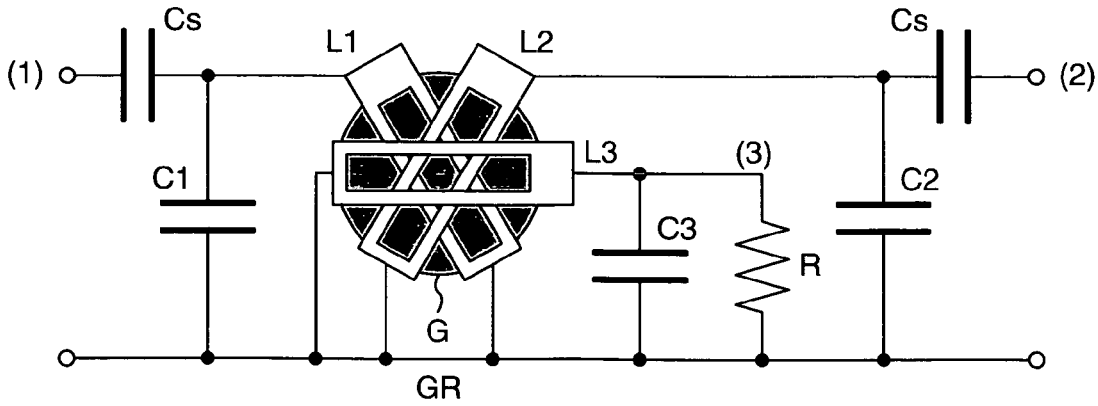
FIG. 5 shows an equivalent circuit of the isolator based on the non-reciprocal element with three central conductors according to the invention.

FIG. 5 is a diagram showing an equivalent circuit of the isolator used for substantiating the effects of the invention. The difference from FIG. 2 lies in that a series capacitor Cs is added between the isolator body and each of the input terminal (1) and the output terminal (2), respectively. The capacitor Cs is for impedance change and used in the case where the impedance in the isolator is high.

[Electrical Characteristics]

Figure 6A:
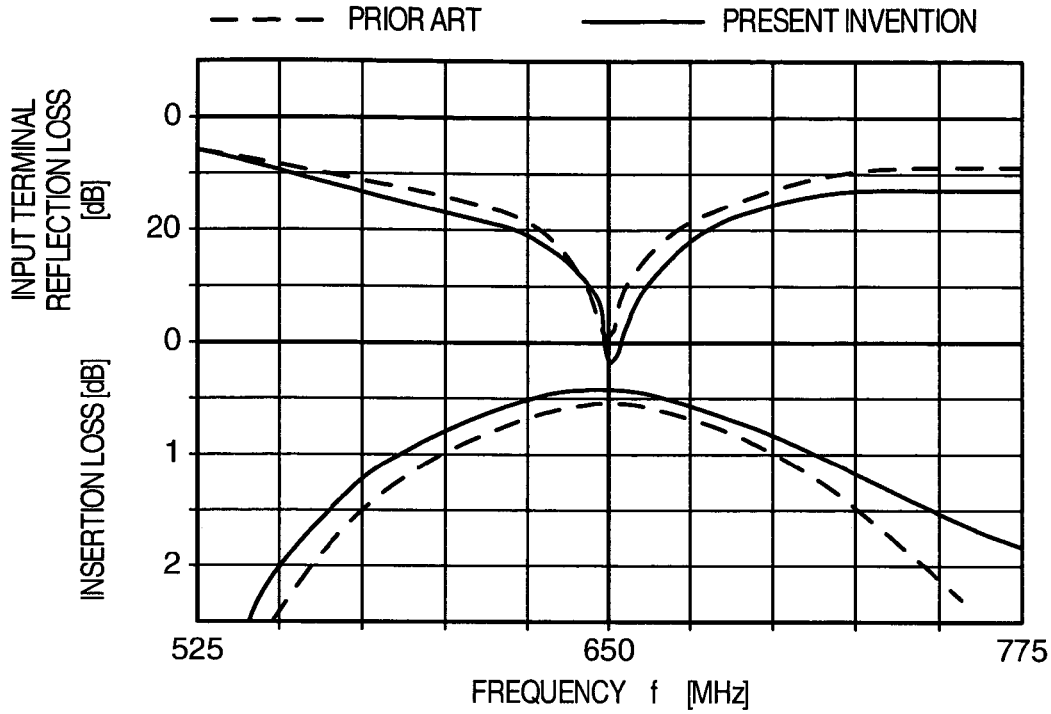
FIGS. 6A and 6B are diagrams for comparing the characteristics of the isolator according to the invention and the characteristics of the conventional isolator.
Figure 6B:
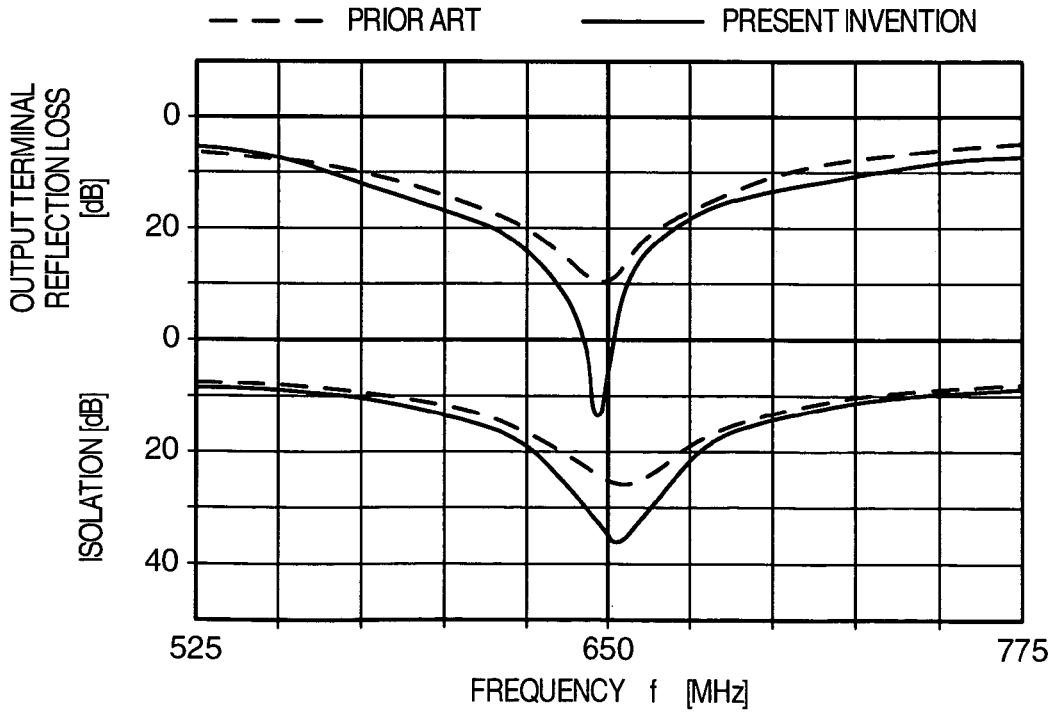

FIGS. 6A, 6B show the electrical characteristics as the result of an experiment conducted using 6 mm ϕ garnet. The result of the experiment for the prior art is indicated by dotted lines and that for the invention by solid lines. The ordinate represents the loss level, and the abscissa the frequency. The central frequency is in 650 MHz band. FIG. 6A shows the frequency characteristic with respect to the reflection loss characteristic and the insertion loss characteristic of the input terminal, and FIG. 6B that of the output terminal. An especially conspicuous change develops in the insertion loss characteristic in FIG. 6A. It has been found that the invention achieves an improvement of about 0.02 dB to 0.05 dB in terms of the insertion loss peak value. The bandwidth is also wider as shown. Comparison by the 20-dB relative bandwidth of the reflection loss at the input terminal shows that the figure is 6% for the prior art and 8% or more for the invention. This substantiates that the advantage of the invention is conspicuous.

[2] Second Embodiment

Figure 7A:
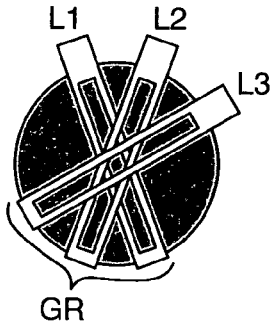
FIGS. 7A and 7B are assembly diagrams of the central conductors and the ferrite thin plate according to an embodiment of the invention.
Figure 7B:
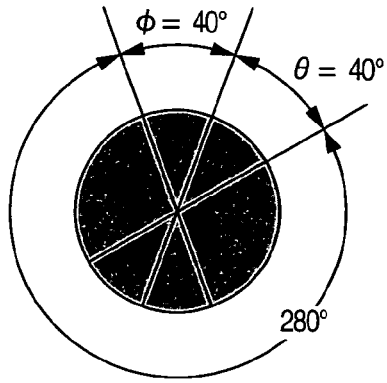

FIGS. 7A and 7B show another embodiment of the invention. This embodiment represents a case in which the intersection angle ϕ between the first central conductor L1 and the second central conductor L2 is 40 degrees, and the intersection angle θ between the second central conductor L2 and the third central conductor L3 is also 40 degrees. Both angles are smaller than 60 degrees.

[3] Third Embodiment

Figure 8A:
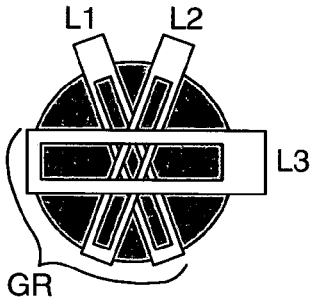
FIGS. 8A and 8B are assembly diagrams of the central conductors and the ferrite thin plate according to an embodiment of the invention.
Figure 8B:
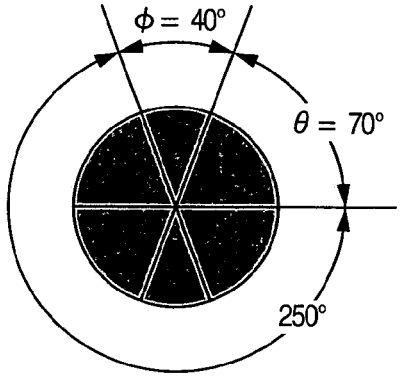

FIGS. 8A and 8B show still another embodiment of the invention, in which the intersection angle ϕ between the first central conductor L1 and the second central conductor L2 is 40 degrees, and the intersection angle θ between the second central conductor L2 and the third central conductor L3 is 70 degrees. In this case, 70 degrees is selected as one half of the supplementary angle of 40 degrees. Also, the interval between the two conductor lines of the third central conductor L3 is wider. This is designed to prevent the central portion of the third central conductor from being superposed on the other central conductors when the former is bent and laid and thus to keep a low real height of the isolator. By doing so, the impedance of the central conductor L3 naturally changes, and therefore the value of the resistor R connected also requires a corresponding adjustment.

[4] Fourth Embodiment

Figure 9A:
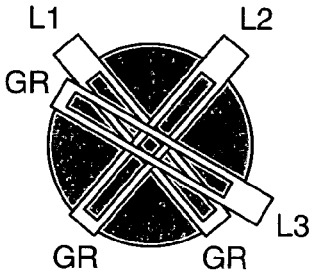
FIGS. 9A and 9B are assembly diagrams of the central conductors and the ferrite thin plate according to an embodiment of the invention.
Figure 9B:
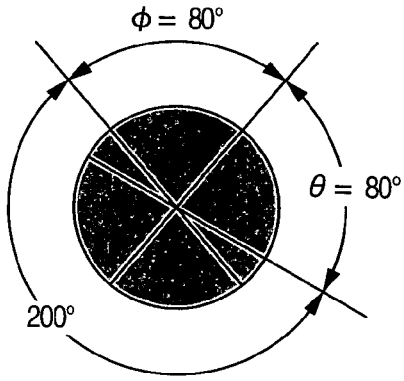

FIGS. 9A and 9B show yet another embodiment of the invention. This represents a case in which the intersection angle ϕ between the first central conductor L1 and the second central conductor L2 is 80 degrees, and the intersection angle θ between the second central conductor L2 and the third central conductor L3 is 80 degrees, both angles being larger than 60 degrees.

[5] Fifth Embodiment

Figure 10A:
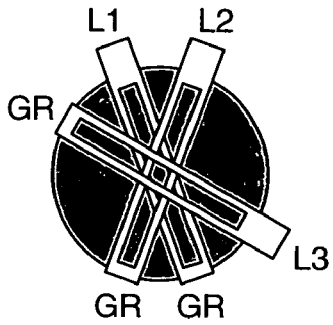
FIGS. 10A and 10B are assembly diagrams of the central conductors and the ferrite thin plate according to an embodiment of the invention.
Figure 10B:
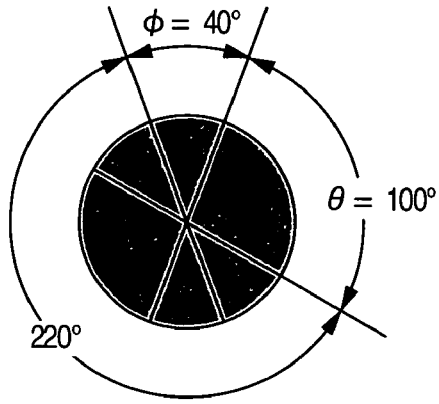

FIGS. 10A and 10B show a further embodiment of the invention. This represents a case in which the intersection angle ϕ between the first central conductor L1 and the second central conductor L2 is 40 degrees, and the intersection angle θ between the second central conductor L2 and the third central conductor L3 is 100 degrees. In this case, the former figure is smaller than 90 degrees, and the latter figure is larger than 90 degrees.

As understood from the foregoing description, the feature of the non-reciprocal element with three central conductors according to the invention lies in that the intersection angle ϕ between the first central conductor L1 and the second central conductor L2 and the intersection angle θ between the second central conductor L2 and the third central conductor L3 are never larger than 90 degrees at the same time. In the case where the angle undergoes a change while holding the relation θ=ϕ, the value θ+ϕ never exceeds 180 degrees. This corresponds to the cases of FIGS. 1A, 1B, 7A, 7B and 9A, 9B.

As a special case, the highest symmetry is achieved when ϕ=θ=60 degrees. This corresponds to the embodiments shown in FIGS. 1A, 1B. Also, the relation ϕ+θ=90 degrees is the special condition for the orthogonal intersection between the central conductor L1 and the central conductor L3, in which case ϕ=θ=45 degrees.

[6] Sixth Embodiment

Figure 11A:
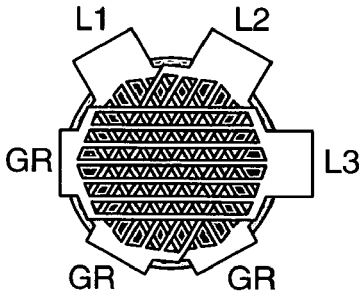
FIGS. 11A and 11B are assembly diagrams of the central conductors and the ferrite thin plate according to an embodiment of the invention.
Figure 11B:
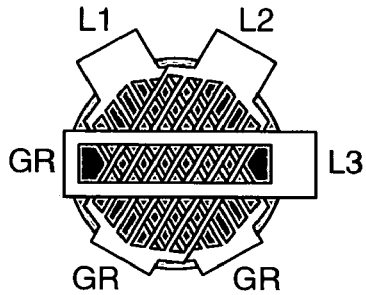

FIGS. 11A and 11B show a still further embodiment of the invention in which ϕ=θ=60 degrees. Each central conductor is so shaped as to have seven instead of two parallel conductor lines. This is designed to generate the radio frequency magnetic field as uniformly as possible over the whole surface of the ferrite thin plate. In this case, however, the line capacity is liable to increase, and therefore, the number of conductor lines and the width of each conductor line should be carefully determined. FIG. 11A shows a case in which all of the three central conductors have seven parallel conductor lines, and FIG. 11B a case in which only the third central conductor L3 has two parallel conductor lines.

[7] Seventh Embodiment

Figure 12A:
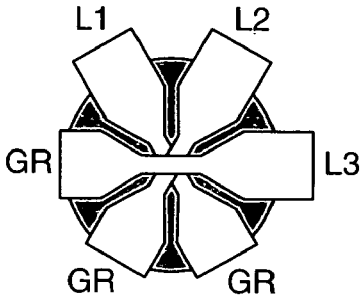
FIGS. 12A and 12B are assembly diagrams of the central conductors and the ferrite thin plate according to an embodiment of the invention.
Figure 12B:
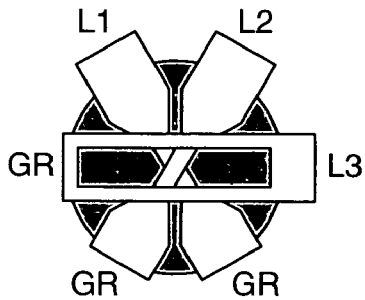

FIGS. 12A and 12B show a yet further embodiment of the invention in which the relation ϕ=θ=60 degrees holds. Each central conductor has one conductor line instead of two parallel conductor lines. In order to reduce the line capacity as far as possible, the central portion of each conductor line is narrowed. In FIG. 12A, all the three central conductors have one conductor line, and in FIG. 12B, only the third central conductor L3 has two parallel conductor lines. This design is intended to prevent the central portion of the third central conductor from being superposed on the other central conductors when the former is laid by being bent and thus to keep a low real height of the isolator.

[8] Eighth Embodiment

Figure 13:
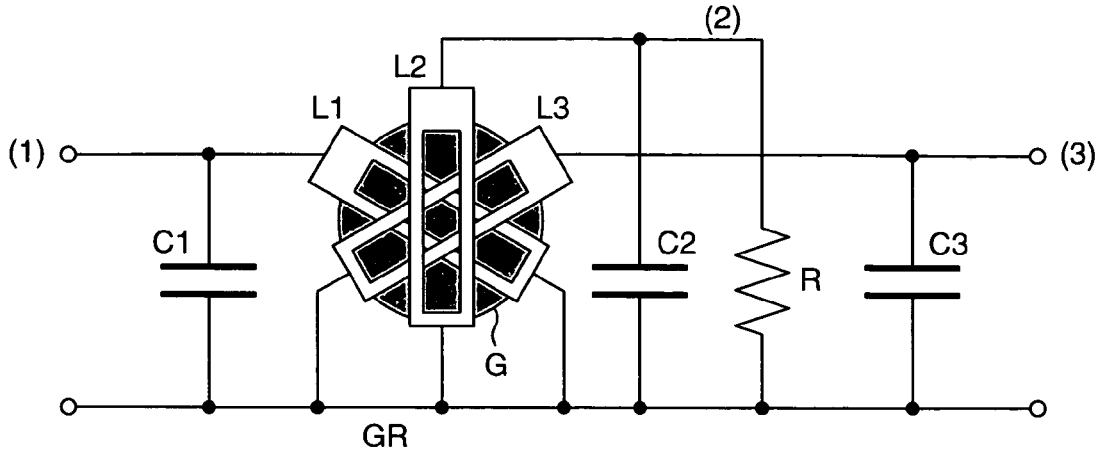
FIG. 13 shows an equivalent circuit of the isolator based on the non-reciprocal element with three central conductors according to the invention.

FIG. 13 shows another embodiment of the invention, in which the resistor R is connected to the second central conductor L2. The input terminal and the output terminal are designated by (1) to (3). Also in this case, the central conductor can be shaped as shown in FIG. 4B, and therefore the effects of the invention can be exhibited especially for improving the isolation bandwidth.

[9] Ninth Embodiment

Figure 14:
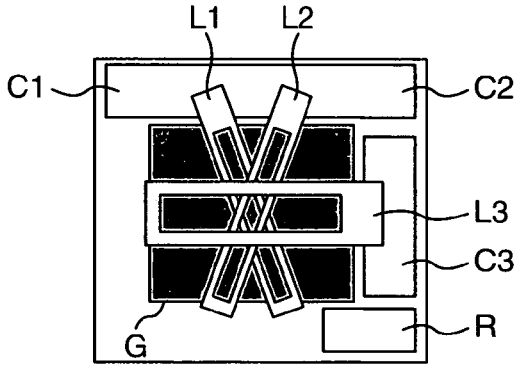
FIG. 14 shows a layout of the capacitor, the resistor, the central conductors and the ferrite thin plate according to an embodiment of the invention.

FIG. 14 shows still another embodiment of the invention comprising the assembly of central conductors with $\theta$=40 degrees and $\phi$=70 degrees and a rectangular ferrite thin plate whose rectangular area roughly contains capacitors C1, C2, C3 and a resistor R. The capacitors C1, C2 are composed of a single structure by arranging the electrodes on the two surfaces of a ceramic single plate. The capacitor C3 and the resistor R are arranged separately from this structure. The capacitors are not necessarily formed of the ceramic single plate, and the same effect is achieved by a ceramic stack structure.

[10] Tenth Embodiment

Figure 15:
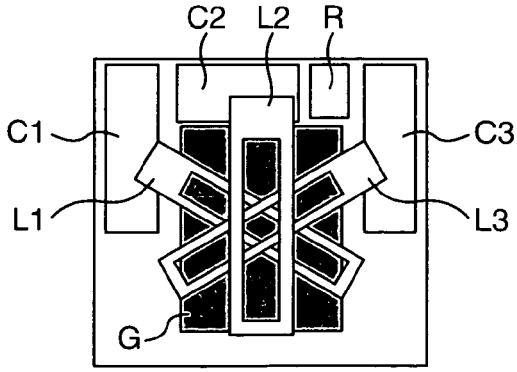
FIG. 15 shows a layout of the capacitor, the resistor, the central conductors and the ferrite thin plate according to an embodiment of the invention.

FIG. 15 shows yet another embodiment of the invention, in which the input terminal constitutes the central conductor L1 and the output terminal constitutes the central conductor L3. As in the embodiment shown in FIG. 13, the capacitors C1, C2, C3 and the resistor R are arranged within a rectangular area. The capacitors C1, C2, C3 and the resistor R, however, are configured as separate structures from each other.

[11] Eleventh Embodiment

Figure 16:
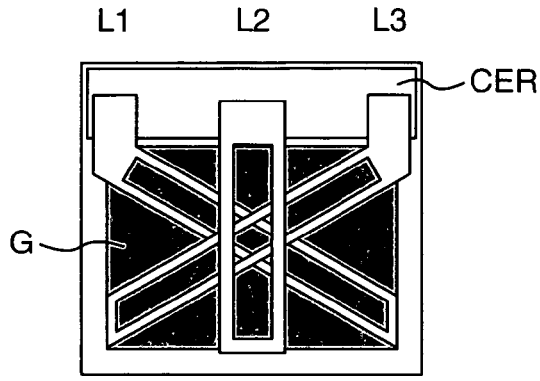
FIG. 16 shows a layout of the capacitor, the resistor, the central conductors and the ferrite thin plate according to an embodiment of the invention.

FIG. 16 shows yet another embodiment of the invention. In this embodiment, an end each of the input/output terminals (1), (2), (3) of the first central conductor L1, the second central conductor L2 and the third central conductor L3, respectively, is laterally arranged in juxtaposition on one side of the rectangular ferrite thin plate. This configuration is another feature of the central conductors according to the invention. This embodiment represents a modification of the embodiment shown in FIG. 15 in which the input terminal is constituted of the central conductor L1 and the output terminal is constituted of the central conductor L3. This embodiment is thus different from the embodiment shown in FIG. 15 in that the capacitors C1, C2, C3 and the resistor R are formed as an integral stack structure CER. By doing so, the stack structure CER as well as the whole structure can be reduced in size, thereby effectively reducing the cost.

Figure 17A:
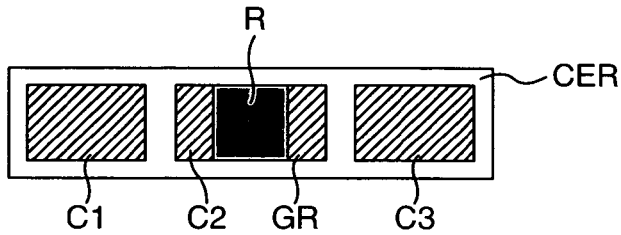
FIGS. 17A, 17B and 17C are diagrams showing the capacitor and the resistor assembled integrally according to an embodiment of the invention.
Figure 17B:
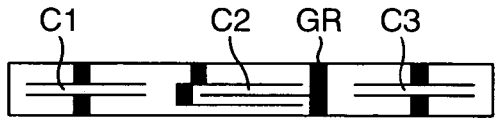
Figure 17C:
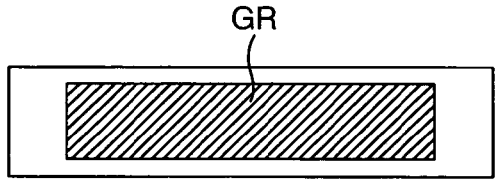

FIGS. 17A to 17C are developments of the integral stack structure CER shown in FIG. 16. FIG. 17A is a top plan view, FIG. 17B a side sectional view, and FIG. 17C a bottom plan view. A single ceramic stack structure contains the capacitors C1, C2, C3, and has the resistor R printed and baked on the upper surface thereof. The bottom surface of the ceramic stack structure, on the other hand, is printed and baked with a ground electrode GR. Parts GR on the upper and bottom surfaces are connected to each other by a through hole. In order to improve the electrostatic capacitance of each capacitor, the opposed electrodes of each capacitor are connected to the upper and lower surfaces by a through hole.

[12] Twelfth Embodiment

Figure 18:
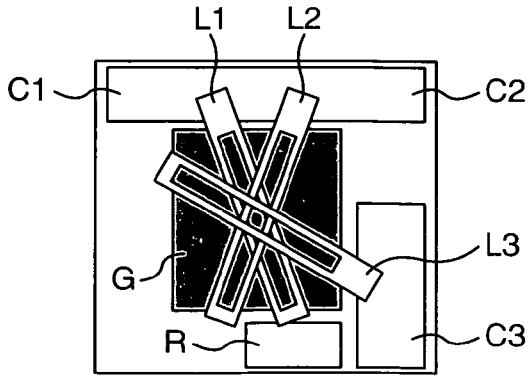
FIG. 18 shows a layout of the capacitor, the resistor, the central conductors and the ferrite thin plate according to an embodiment of the invention.

FIG. 18 shows still another embodiment of the invention, in which the assembly of the rectangular ferrite thin plate and the central conductors with $\phi$ of 40 degrees and $\theta$ of 100 degrees, capacitors C1, C2, C3 and the resistor R arranged in a rectangular area. The input terminal is connected to the central conductor L1, and the output terminal to the central conductor L2. The capacitors C1, C2 are integrated in a single structure, while the capacitor C3 and the resistor R are separated from the integrated structure.

[13] Embodiments of Communication Apparatus

Figure 19:
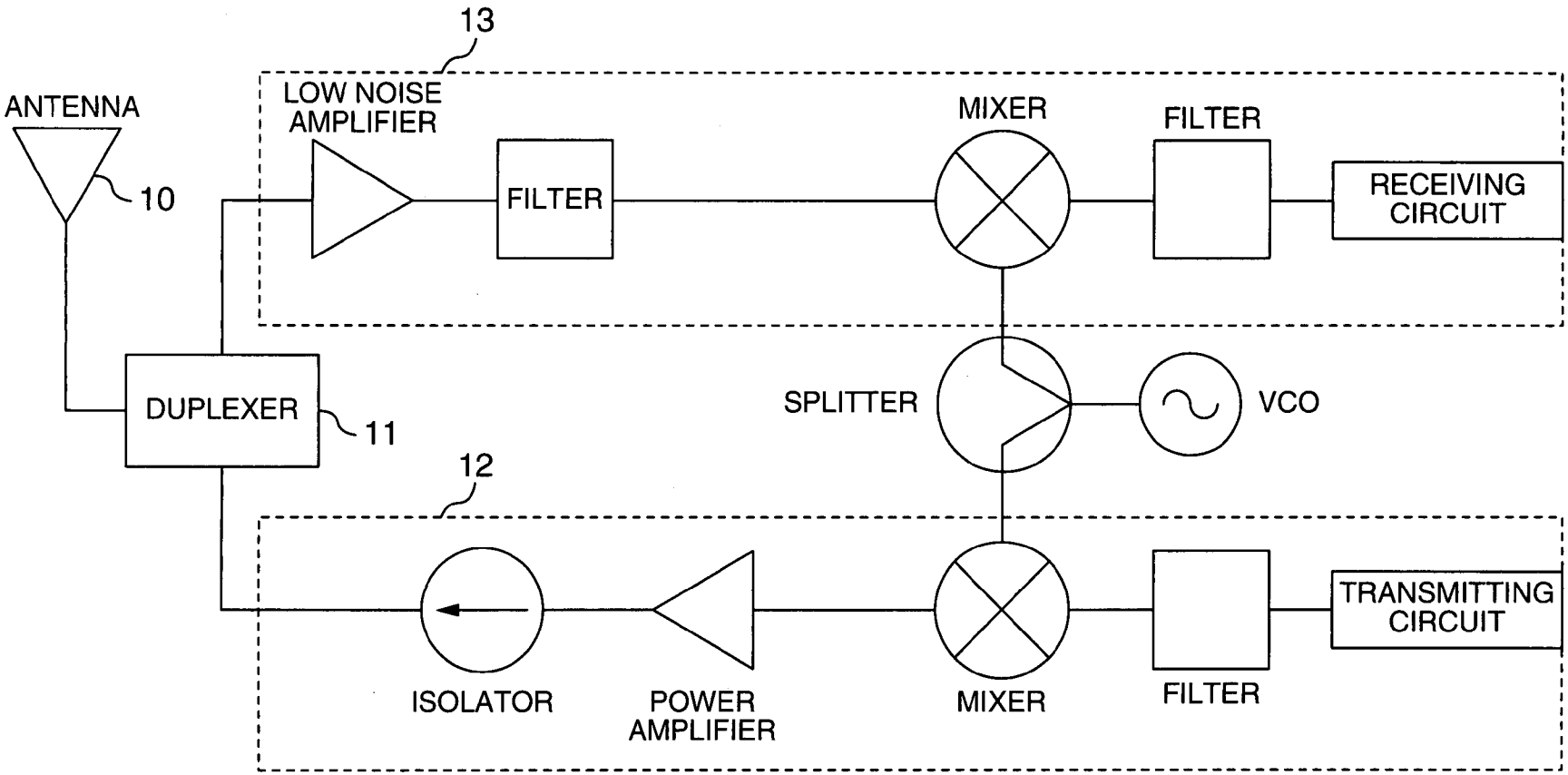
FIG. 19 is a circuit block diagram of a communication apparatus according to an embodiment of the invention.
Figure 20A:
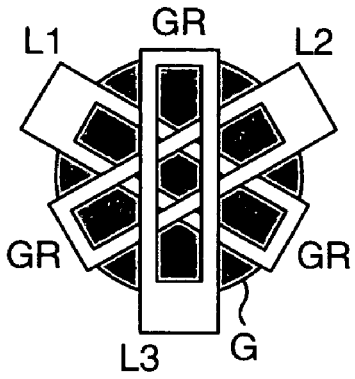
FIG.20A PRIOR ART
FIGS. 20A and 20B are assembly diagrams of the central conductors and the ferrite thin plate according to the prior art.
Figure 20B:
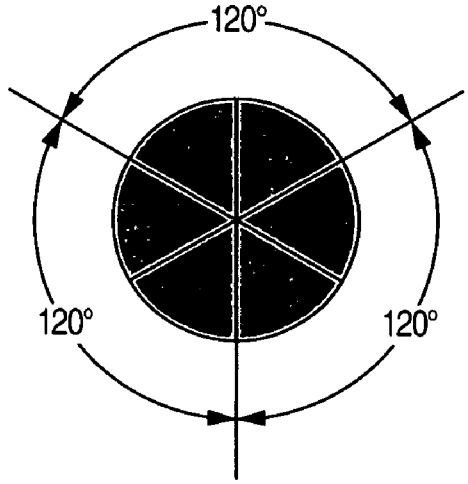
FIG.20B PRIOR ART
Figure 21:
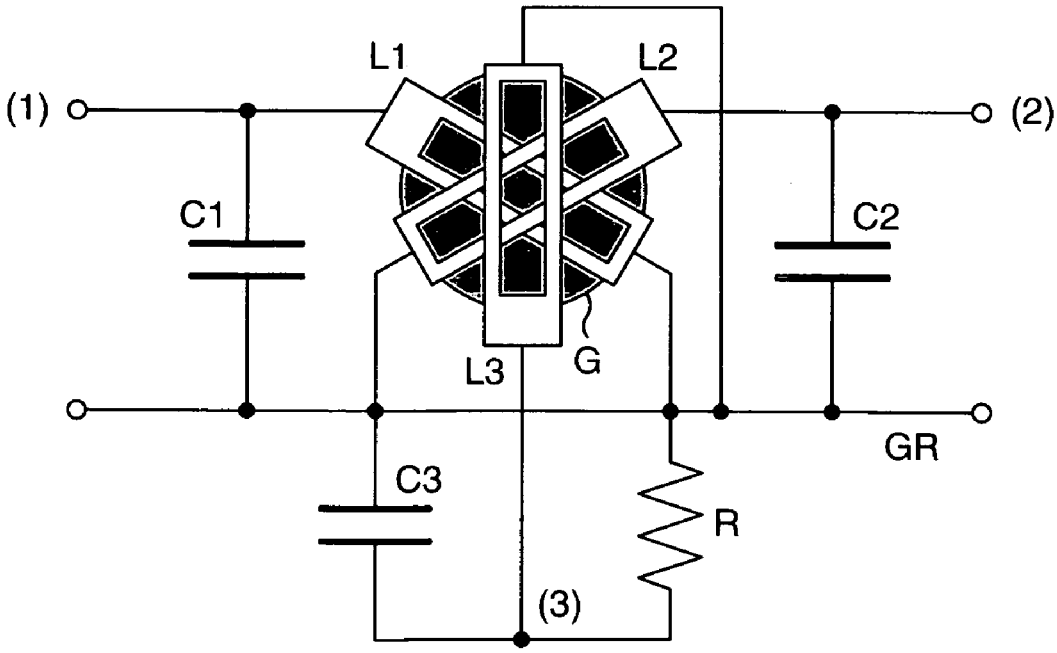
FIG.21 PRIOR ART
FIG. 21 shows an equivalent circuit of the isolator based on the conventional non-reciprocal element with three central conductors.

FIG. 19 shows an example of the electrical circuit blocks of the RF section of the mobile phone. This embodiment includes an antenna 10, a duplexer 11 having a transmitting filter and a receiving filter, a transmitting circuit 12 connected with the input/output means on the transmitting filter side of the duplexer, and a receiving circuit 13 connected to the input/output means on the receiving filter side of the duplexer. Briefly, the transmitting circuit 12 includes, as arranged from the transmitting side, a filter, a mixer and a power amplifier in that order, and the transmitting signal is amplified by the power amplifier and transmitted from the antenna 10 through the transmitting filter of the duplexer 11 after being passed through the isolator according to the invention. The receiving signal, on the other hand, is sent from the antenna 10 to the receiving circuit 13 through the receiving filter of the duplexer 11. After being amplified by a low-noise amplifier in the receiving circuit and passing through the filter, the signal is mixed by a mixer with a local oscillation signal distributed from a voltage controlled oscillator VCO by a splitter and converted into an intermediate frequency.

This configuration of the radio communication apparatus is only an example. The use of the non-reciprocal element with three central conductors according to the invention realizes a communication apparatus with a low loss, a wide bandwidth and high reliability.

It will thus be understood from the foregoing description that according to the invention, there is provided a non-reciprocal element with three central conductors constituting an isolator/circulator having a small insertion loss, a wide bandwidth and a low cost. This greatly contributes to an improved cost per performance.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A non-reciprocal element with three central conductors, comprising:

a ferrite thin plate with a static magnetic field being applied by a permanent magnet; and first, second and third central conductors arranged in proximity to the ferrite thin plate, to cross each other in an electrically insulated state;

wherein an end of each of the first, second and third central conductors constitutes first, second and third input/output terminals, respectively, and the other end thereof is connected to a common portion;

wherein first, second and third matching capacitors are inserted between the first, second and third input/output terminals, respectively, and the common portion; and wherein a resistor is connected between selected one of the first, second and third input/output terminals and the common portion, one of the remaining two input/output terminals constitutes an input terminal while the other remaining input/output terminal constitutes an output terminal, a central conductor portion directly connected to the input terminal and a central conductor portion directly connected to the output terminal are arranged at an intersection angle, as viewed from a position disposed between central conductor portions directly connected to the input terminal and the output terminal, of less than 90 degrees with each other; and wherein the intersection angle, as viewed from the position disposed between the input terminal and the output terminal, of the central conductor having the input terminal and the central conductor having the output terminal is about 60 degrees.

2. A non-reciprocal element with three central conductors according to claim 1, wherein the input/output terminals of an end of each of the first, second and third central conductors, respectively, are juxtaposed laterally and linearly along one side of the ferrite thin plate.

3. A non-reciprocal element with three central conductors according to claim 1, wherein the central portion of at least one of the first, second and third central conductors is divided into at least three conductor lines.

4. A non-reciprocal element with three central conductors according to claim 1, wherein said common portion is a ground conductor.

5. A non-reciprocal element with three central conductor comprising:

a ferrite thin plate with a static magnetic field being applied by permanent magnet; and first second and third central conductors arranged in proximity to the ferrite thin plate, to cross each other in an electrically insulated state;

wherein an end of each of the first, second and third central conductors constitutes first, second and third input/output terminals, respectively, and the other end thereof is connected to a common portion;

wherein first, second and third matching capacitors are inserted between the first, second and third input/output terminals, respectively, and the common portion; and wherein a resistor is connected between selected one of the first, second and third input/output terminals and the common portion, one of the remaining two input/output terminals constitutes an input terminal while the other remaining input/output terminal constitutes an output terminal, a central conductor portion directly connected to the input terminal and a central conductor portion directly connected to the output terminal are arranged at an intersection angle, as viewed from a position disposed between central conductor oportions directly connected to the input terminal and the output terminal, of less than 90 degrees with each other;

wherein the input terminal and the output terminal are arranged adjacently to each other without any other terminal disposed therebetween; and wherein an intersection angle, as viewed from a position disposed between the input/output terminal connected to the resistor and a closest one of the input terminal and the output terminal, of a central conductor having the input/output terminal connected to the resistor and a closest one of the central conductor having the input terminal and the central conductor having the output terminal is not more than 90 degrees.

6. A non-reciprocal element with three central conductors according to claim 5, wherein an intersection angle, as viewed from the position disposed between the input terminal and the output terminal, of the central conductor having the input terminal and the central conductor having the output terminal is about 60 degrees; and wherein an intersection angle, as viewed from a position disposed between the input/output terminal connected to the resistor and a closest one of the input terminal and the output terminal, of a central conductor having the input/output terminal connected to the resistor and a closest one of the central conductor having the input terminal and the central conductor having the output terminal is not more than 90 degrees.

7. A non-reciprocal element with three central conductors, comprising:

a ferrite thin plate with a static magnetic field being applied by a permanent magnet; and first, second and third central conductors arranged in proximity to the ferrite thin plate, to cross each other in an electrically insulated state;

wherein an end of each of the first, second and third central conductors constitutes first, second and third input/output terminals, respectively, and the other end thereof is connected to a common portion;

wherein first, second and third matching capacitors are inserted between the first, second and third input/output terminals, respectively, and the common portion; and wherein a resistor is connected between selected one of the first, second and third input/output terminals and the common portion, one of the remaining two input/output terminals constitutes an input terminal while the other remaining input/output terminal constitutes an output terminal, a central conductor portion directly connected to the input terminal and a central conductor portion directly connected to the output terminal are arranged at an intersection angle, as viewed from a position disposed between central conductor portions directly connected to the input terminal and the output terminal, is about 60 degrees.

8. A non-reciprocal element with three central conductors according to claim 7, wherein the input/output terminals of an end of each of the first, second and third central conductors, respectively, are juxtaposed laterally and linearly along one side of the ferrite thin plate.

9. A non-reciprocal element with three central conductors according to claim 7, wherein said common portion is a ground conductor.

10. A communication apparatus comprising at least a non-reciprocal element with three central conductors according to claim 7.

11. A non-reciprocal element with three central conductors, comprising:

a ferrite thin plate with a static magnetic field being applied by a permanent magnet; and first, second and third central conductors arranged in proximity to the ferrite thin plate, to cross each other in an electrically insulated state;

wherein an end of each of the first, second and third central conductors constitutes first, second and third input/output terminals, respectively, and the other end thereof is connected to a common portion;

wherein first, second and third matching capacitors are inserted between the first, second and third input/output terminals, respectively, and the common portion; and wherein a resistor is connected between selected one of the first, second and third input/output terminals and the common portion, one of the remaining two input/output terminals constitutes an input terminal while the other remaining input/output terminal constitutes an output terminal, wherein longitudinal axes of the central conductors having the input and output terminals thereon overlap with each other at an intersection point, and wherein an angle having one side defined by the longitudinal axis between the intersection point and a central conductor portion directly connected to an input, and another side defined by the longitudinal axis between the intersection point and a central conductor portion directly connected to an output, is 90 degrees or less; and wherein an intersection angle, as viewed from a position disposed between the input/output terminal connected to the resistor and a closest one of the input terminal and the output terminal, of a central conductor having the input/output terminal connected to the resistor and a closest one of the central conductor having the input terminal and the central conductor having the output terminal is not more than 90 degrees.

* * * * *